US012139882B2

(12) United States Patent
Anderson

(10) Patent No.: US 12,139,882 B2
(45) Date of Patent: Nov. 12, 2024

(54) APPARATUS AND METHOD FOR UNDERWATER DREDGING

(71) Applicant: Subsea Tooling Services UK Ltd, Aberdeenshire (GB)

(72) Inventor: Cameron Edward Anderson, Banff (GB)

(73) Assignee: Subsea Tooling Services UK Ltd., Aberdeenshire (GB)

( * ) Notice: Subject to any disclaimer, the term of this patent is extended or adjusted under 35 U.S.C. 154(b) by 0 days.

(21) Appl. No.: 18/110,653

(22) Filed: Feb. 16, 2023

(65) Prior Publication Data

US 2023/0279636 A1 Sep. 7, 2023

(30) Foreign Application Priority Data

Feb. 16, 2022 (GB) ..... 2202074

(51) Int. Cl.
*E02F 3/92* (2006.01)
*E02F 3/88* (2006.01)

(52) U.S. Cl.
CPC ..... *E02F 3/8866* (2013.01); *E02F 3/925* (2013.01)

(58) Field of Classification Search
CPC . E02F 3/8866; E02F 3/925; E02F 3/90; E02F 3/88; E02F 3/902; E02F 3/9212
See application file for complete search history.

(56) References Cited

U.S. PATENT DOCUMENTS 2,044,088 A * 6/1936 Lord ..... E02F 3/90 417/151
2,096,595 A * 10/1937 Sanford ..... E02F 3/902 417/279

(Continued)

FOREIGN PATENT DOCUMENTS

CN 2737839 Y 11/2005
CN 111197328 A 5/2020

(Continued)

OTHER PUBLICATIONS

Patent Act 1977: Search Report under Section 17 dated May 17, 2023 received in GB2302137.1.

(Continued)

*Primary Examiner* — Jamie L McGowan
(74) *Attorney, Agent, or Firm* — Hunton Andrews Kurth LLP

(57) ABSTRACT

An apparatus (1) for underwater dredging includes a pipe (10) and a dredging head (2). The pipe (10) has a first aperture (11) and a second aperture (12) each disposed at opposing ends of the pipe (10). The pipe (10) also has at least one first sidewall aperture (13). The dredging head (2) is circumferentially arranged on a sidewall of the pipe (10) and has at least one input (20), at least one output (21) and a plenum chamber (22). The at least one output (21) is in fluid communication with the at least one first sidewall aperture (13). A first obstruction mechanism (23) is configured to selectively deter reverse fluid flow into the dredging head (2). The first obstruction mechanism (23) is configured to be selectively transformable between: a first, obstructing, configuration in which at least reverse fluid flow through the dredging head (2) is deterred; and a second, open, configuration in which fluid flow through the dredging head (2) is (Continued)

permitted. A method of underwater dredging is also described.

21 Claims, 16 Drawing Sheets

(56) References Cited

U.S. PATENT DOCUMENTS

| | | | | | |
|---|---|---|---|---|---|
| 2,125,740 | A | | 8/1938 | Schacht | |
| 2,324,422 | A | * | 7/1943 | Patterson | A47L 5/18 417/183 |
| 4,027,407 | A | * | 6/1977 | Kiss | F04F 5/48 60/221 |
| 4,322,897 | A | | 4/1982 | Brassfield | |
| 4,400,138 | A | * | 8/1983 | Baer | B01F 25/314 417/195 |
| 4,681,372 | A | | 7/1987 | McClure | |
| 4,822,106 | A | * | 4/1989 | Wilson | E02F 7/023 299/9 |
| 4,945,661 | A | * | 8/1990 | Kuioka | E02F 3/8841 406/60 |
| 5,593,252 | A | * | 1/1997 | Relin | B65G 53/24 406/151 |
| 6,979,152 | B2 | * | 12/2005 | Bodie | B65G 53/42 37/318 |
| 7,591,088 | B1 | * | 9/2009 | Schuh | E02F 3/885 37/317 |
| 2004/0010947 | A1 | * | 1/2004 | Hutchinson | E02F 3/40 37/317 |
| 2007/0130807 | A1 | * | 6/2007 | Kohutko | E02F 3/9243 37/341 |

FOREIGN PATENT DOCUMENTS

| | | | | |
|---|---|---|---|---|
| CN | 113047357 | A | | 6/2021 |
| EP | 0496481 | A2 | | 7/1992 |
| JP | 2007-113295 | A | | 5/2007 |
| JP | 2008115610 | A | * | 5/2008 |
| KR | 1020150139063 | | | 12/2015 |

OTHER PUBLICATIONS

Patent Act 1977: Examination Report under under Section 18(3) dated May 18, 2023 received in GB2302137.1.

Patent Act 1977: Search Report under Section 17 dated Aug. 18, 2022 received in GB2202074.7.

Intention to Grant dated Feb. 6, 2024 received in GB 2302137.1.

Examination Report under Section 18(3) dated May 18, 2023 received in GB 2302137.1.

European Search report dated Jul. 3, 2023 issued in European application 23156808.

* cited by examiner 2
29a
25
29
24
15
10
23

48
20
27a
27
22
11
10
13
21
2
12
2

ALTERNATIVE PLENUM CHAMBER WITH ELBOWS (NO VALVES)

ALTERNATIVE VENTURI FLOW SHUT-OFF

VENTURI RING - CLOSED

VENTURI RING - OPEN

SECTION Z-Z

PART SECTION Z-Z

SECTION V-V

PART SECTION Z-Z

SECTION W-W

SECTION Z-Z

SECTION Y-Y

SECTION Z-Z

SECTION Y-Y

APPARATUS AND METHOD FOR UNDERWATER DREDGING

TECHNICAL FIELD

The present invention relates to devices and methods for dredging of materials from beds of bodies of water.

BACKGROUND OF THE INVENTION

When underwater cables, pipes and structures are to be laid in, erected on, or removed from beds of bodies of water, material frequently needs to be removed and/or added to the substrate in dredging or excavation operations. These operations are conducted either by a diver, a remotely operated vehicle (ROV), or directly from a surface vessel.

Dredgers are used to remove material from the seabed by mechanical action and/or suction. The extracted material is then moved either to a nearby area, or transported elsewhere. Surface vessels are often used for dredging operations, but they can lack precision and risk causing significant damage to the natural environment. ROVs and divers can offer increased precision. However, to facilitate this, any equipment needs to be of a suitable size to allow a diver and/or an ROV to efficiently and safely manipulate it during dredging of the seabed (where the term seabed refers to any solid or sedimentary surface lying below a body of water).

Mass-flow excavators also move material on the seabed, but instead of suction, they blow the material out of the way by using a column of moving water to excavate the substrate. Such excavators are often lowered and controlled from a surface vessel and remain tethered to it. Mass-flow excavation is often used for deburial of pipes and cables, or trenching. Modern mass-flow excavators comprise a thruster in a tube which generates a fluid flow directly. The end of the tube is then directed at the seabed where it ejects material from the vicinity. Making such excavation amenable to divers and/or ROVs will also require any equipment to be of a suitable size.

Neither dredging nor mass flow excavation singularly achieves precise removal or addition of material from or to the seabed. Consequently, both tools are usually required to complete a single task, which can involve multiple changes between the tools. Each time a change is made from one tool to another, work on the task at hand is forced to stop for a considerable period, while one tool is removed from the seabed and the other takes its place. It can be a slow and expensive process to change between tools, particularly those submerged at any great depth such as a seabed.

The present invention seeks to address these problems of the prior art.

SUMMARY OF THE INVENTION

According to the present invention there is provided an apparatus for underwater dredging comprising: a pipe and a dredging head; wherein the pipe comprises a first aperture and a second aperture each disposed at opposing ends of the pipe, and the pipe further comprises at least one first sidewall aperture; wherein the dredging head is circumferentially arranged on a sidewall of the pipe and comprises at least one input, at least one output and a plenum chamber; wherein the at least one output is in fluid communication with the at least one first sidewall aperture; and further comprising a first obstruction mechanism configured to selectively deter reverse fluid flow into the dredging head, wherein the first obstruction mechanism is configured to be selectively transformable between:— i) a first, obstructing, configuration in which at least reverse fluid flow through the dredging head is deterred; and ii) a second, open, configuration in which fluid flow through the dredging head is permitted.

For the purposes of this invention, reverse flow is fluid flow in the direction from at least one output to at least one input. In this context, fluid flow may also relate to particle suspensions or particles per se.

Optionally, the apparatus for underwater dredging additionally comprises at least one thruster tube. Typically, the at least one thruster tube comprises a first thruster aperture, and a second thruster aperture, and preferably further comprises a thruster disposed between the first thruster aperture and the second thruster aperture, such that the apparatus is configured to further provide for mass-flow excavation.

Optionally, the pipe further comprises at least one second sidewall aperture. Typically, the at least one thruster tube is affixed to a sidewall of the pipe, and preferably at least one thruster tube is in fluid communication with the at least one second sidewall aperture.

Optionally, the thruster comprises a propeller rotatable by a motor in order to promote selective fluid flow in the thruster tube. Alternatively, the thruster may comprise other suitable means of promoting fluid flow in the thruster tube including other types of suitable rotodynamic pumps and/or any other suitable type of pump including suitable positive displacement pumps.

Optionally, the at least one output is positioned at and surrounds the at least one first sidewall aperture and is configured to promote fluid flow in the pipe from the first aperture to the second aperture.

Optionally, the at least one thruster tube is affixed to a sidewall of the pipe and is configured to promote fluid flow in the pipe from the second aperture to the first aperture.

Optionally, the first obstruction mechanism selectively obstructs the at least one first sidewall aperture.

Optionally, the first obstruction mechanism selectively obstructs a flow channel through the dredging head.

Optionally, the first obstruction mechanism is provided by fluid control valves, for example, non-return valves, shut-off valves, gate valves etc. in order to prevent or reduce reverse fluid flow into the dredging head.

Optionally, the first obstruction mechanism is activated (to obstruct a flow) by translation of at least one component of the dredging head. The translation of at least one component of the dredging head may be relative to the pipe and/or further components of the dredging head. The translation may comprise, for example, a sliding or helical displacement of at least one component of the dredging head.

Optionally, the first obstruction mechanism is activated by rotation of at least one component of the dredging head. The rotation of at least one component of the dredging head may be relative to the pipe and/or further components of the dredging head.

Optionally, when the first obstruction mechanism is activated it may provide that the at least one output of the dredging head is not aligned with the first sidewall aperture; or optionally that the first sidewall aperture is obstructed.

Optionally, when the first obstruction mechanism is activated it may provide that a flow channel though the dredging head is obstructed or misaligned.

Optionally, the apparatus for underwater dredging, comprises a second obstruction mechanism configured to selectively deter fluid flow between the pipe and the thruster tube.

Optionally, the second obstruction mechanism comprises a valve, for example, a shut-off valve, a one-way valve or a gate valve.

Optionally, the second obstruction mechanism is selectively transformable between:— i) a first, obstructing, configuration in which fluid flow between the pipe and the thruster tube is deterred; and ii) a second, open, configuration in which fluid flow between the pipe and the thruster tube is permitted.

Optionally, wherein the thruster is switchably configured to promote fluid flow between the first thruster aperture and the second thruster aperture in either direction.

Optionally, wherein the thruster tube may be fitted with mesh grills or other means of reducing or preventing the passage of particles, at either or both sides of the thruster and positioned at any point between the first thruster aperture and the second thruster aperture, or adjacent thereto.

Optionally, the thruster tube is affixed to the pipe.

Optionally, the at least one thruster tube is affixed to a sidewall of the pipe and surrounds the at least one second sidewall aperture, wherein the thruster tube is typically affixed at an angle of less than 80 degrees, or preferably less than 60 degrees, or more preferably less than 40 degrees, or even more preferably 30 degrees or less, measured between the centreline of the pipe and the centreline of the thruster tube, optionally when taking the smallest such angle.

Optionally, wherein the centreline of the thruster tube is taken from the point where the thruster tube is affixed to the pipe.

Optionally, the intersection point of the centreline of the pipe and the centreline of the thruster tube is positioned between the first aperture and the centreline of the second sidewall aperture.

Optionally, the thruster tube may comprise a constriction between the thruster and the at least one second sidewall aperture, preferably wherein the constriction is configured to provide the venturi effect when in use.

Optionally, the apparatus for underwater dredging additionally comprises a pump configured for providing fluid to the dredging head.

According to the present invention there is provided a method of underwater dredging, the method comprising the steps of:

a) submerging an apparatus for underwater dredging in a body of water, and in any order;

b) performing a dredging operation, wherein a dredging head issues a first fluid flow into a pipe via an at least one first sidewall aperture, wherein the fluid flow is entering the pipe directed toward a second aperture, such that fluid flow in the pipe from a first aperture to the second aperture is promoted;

c) placing the first aperture of the pipe proximal to the seabed, wherein fluid flow into the first aperture extracts material from the seabed, and transporting said material through the pipe and ejecting it from the second aperture;

d) selectively operating an obstruction mechanism to selectively transform between:— i) a first, obstructing, configuration in which at least reverse fluid flow through the dredging head is deterred; and ii) a second, open, configuration in which fluid flow through the dredging head is permitted.

Optionally, the method of underwater dredging additionally comprises the steps of:

e) performing a mass-flow excavation operation, wherein a thruster tube issues a second fluid flow into the pipe via at least one second sidewall aperture, wherein the fluid flow is entering the pipe directed toward the first aperture, promoting fluid flow from the second aperture to the first aperture, and f) placing the first aperture of the pipe proximal to the seabed, wherein fluid flow out of the first aperture of the pipe ejects material from the seabed.

Optionally, the dredging operation additionally comprises operating a thruster tube to issue a second flow output of the pipe via at least one second sidewall aperture and typically, the fluid flow is exiting the pipe directed away from the first aperture promoting fluid flow in the pipe from a first aperture to the second aperture, Optionally, the dredging operation additionally comprises deterring (i.e. reducing or preventing) fluid flow between the pipe and the thruster tube with a second obstruction mechanism.

Optionally, the mass-flow excavation operation additionally comprises deterring reverse fluid flow into the dredging head with a first obstruction mechanism.

Optionally, fluid may be provided to the dredging head from an external source, e.g. a Remotely Operated Vehicle (ROV), or surface vessel.

Optionally, a pump may be integrated into the apparatus for underwater dredging for providing fluid to the dredging head.

Optionally, the provided fluid may be ambient fluid local to the current location of the apparatus for underwater dredging.

Typically, the at least one input is in fluid communication with the plenum chamber and typically, the plenum chamber is in fluid communication with the at least one output.

Optionally, the at least one output is positioned at the at least one first sidewall aperture and is configured to promote fluid flow in the pipe from the first aperture to the second aperture.

Optionally, the dredging head further comprises at least one venturi.

Optionally, the dredging head may comprise a circular ring comprising a plurality of venturi.

Optionally, the first obstruction mechanism selectively obstructs the at least one first sidewall aperture.

Optionally, the first obstruction mechanism obstructs a flow channel through the dredging head.

Optionally, the first obstruction mechanism is configured to misalign an output of the dredging head with the first aperture.

Optionally, the first obstruction mechanism is configured to misalign a component in a flow channel though the dredging head.

Optionally, the first obstruction mechanism may comprise a fluid control valve, for example, a non-return valve, shut-off valve, gate valve etc.

Optionally, the first obstruction mechanism may be activated by translation of at least one component of the dredging head.

Optionally, the translation of at least one component of the dredging head may be relative to the pipe and/or further components of the dredging head. The translation may comprise, for example, a sliding or helical displacement of at least one component of the dredging head.

Optionally, the first obstruction mechanism may be activated by rotation of at least one component of the dredging head.

Optionally, the rotation of at least one component of the dredging head may be relative to the pipe and/or further components of the dredging head.

Optionally, the second thruster aperture is angled away from the pipe between the second sidewall aperture and the second aperture.

Optionally, a kit of parts for an underwater dredging apparatus may comprise: a dredging head for an underwater dredging apparatus, and a thruster device for an underwater dredging, and at least one pipe reversibly connectable to the dredging head or the thruster device. The dredging head and thruster device are typically selectively connectable such as to be in fluid communication with one another.

Optionally, the kit of parts may contain any additional components disclosed herein.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings and are not to be interpreted as limiting the invention to the literal interpretation of the term, but instead should be as understood by the skilled addressee.

BRIEF DESCRIPTION OF THE DRAWINGS

Embodiments of the present invention will now be described, by way of example only and with reference to the accompanying drawings, in which.

DETAILED DESCRIPTION OF EXAMPLES OF THE INVENTION

Figure 1:
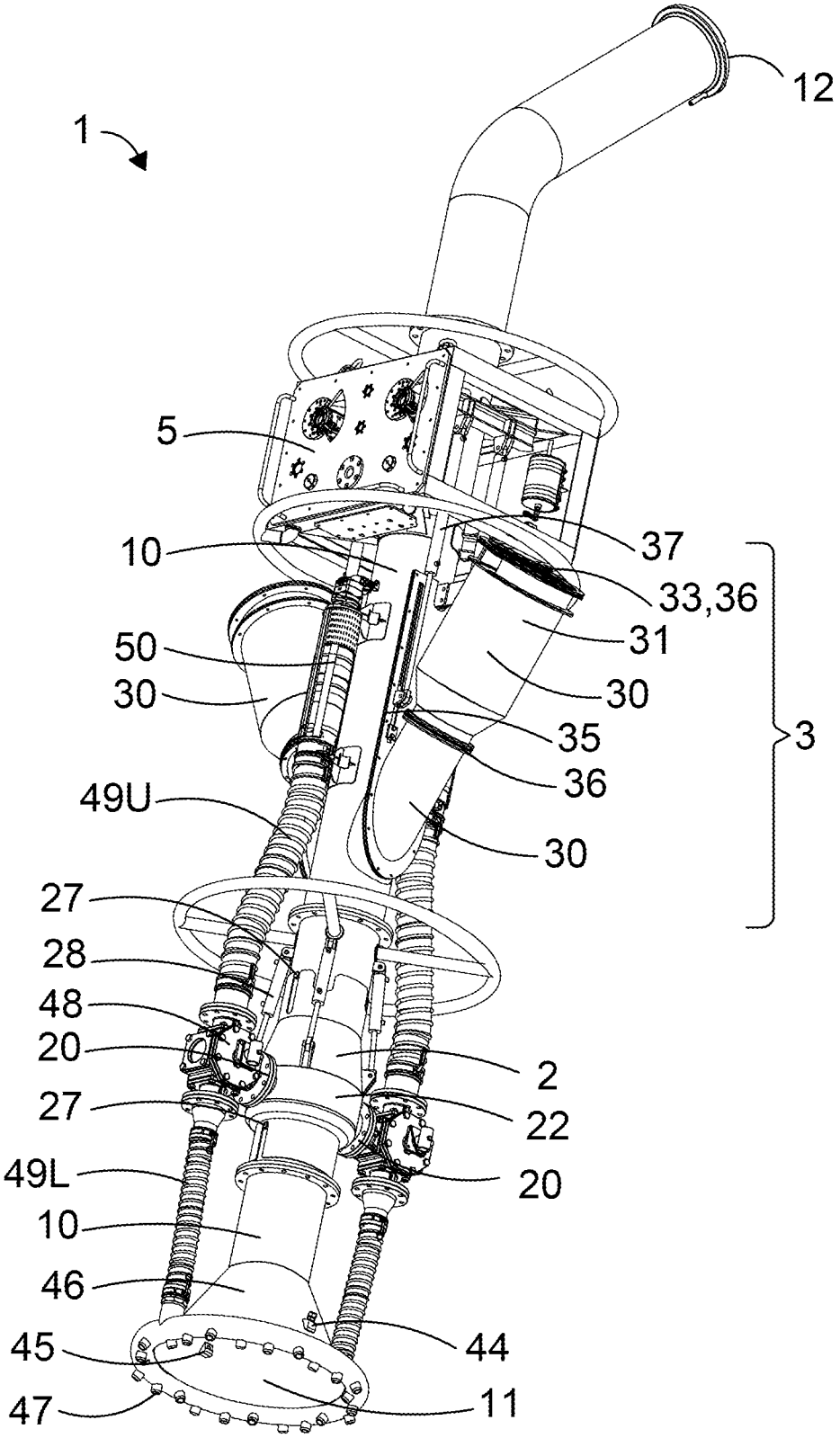
FIG. 1 Shows a perspective view of an example apparatus in accordance with the present invention for underwater dredging and which can also be used for mass-flow excavation.

FIG. 1 illustrates a perspective view of an example apparatus 1 for underwater dredging in accordance with the present invention and which can also be used for mass-flow excavation. The illustration shows an upper (in use) end of an optional suction cone 46 attached to the lower (in use) end of a pipe 10. In this example, a plurality of jetting heads 47 (i.e. jetting nozzles 47) are circumferentially arranged around the in use lower most end of the suction cone 46. The suction cone 46 in this example also comprises an air lift connection 44, which is part of an air lift nozzle 45. A dredging head 2 is shown circumferentially arranged in line in the pipe 10 above (in use) the suction cone 46 and comprising a plenum chamber 22. The plenum chamber 22 comprises:— i) a co-axially arranged sleeve portion 29 adapted to be in a close sliding fit around the outer surface of the tube 10 (having optional plenum alignment slots 27*a* extending downwardly from its in use lowermost end);

ii a venturi ring 25 at its approximate midpoint; and iii) a tapering diameter sleeve portion 29*a* located at the in use uppermost end of the venture ring 25, where the sleeve portion 29 tapers inwardly from its in use lowermost end (adjacent the venture ring 25) toward it's uppermost in use end) (having optional plenum alignment slots 27*a* extending upwardly from its in use uppermost end).

Plenum alignment keys 27 and plenum chamber cylinders 28 are also shown and will be detailed subsequently. In this example, the dredging head 2 is shown with two laterally provided inputs 20, each with an optional flow control valve 48 attached. A flexi hose 49U is shown connected to output of pump 50 at its uppermost (in use) end and an input of the flow control valve 48 at the other (in use) lowermost end. A second flexi hose 49L is shown connecting an output of the flow control valve 48 to the plurality of jetting heads 47 (i.e. jetting nozzles) which are circumferentially arranged around the lowermost (in use) end of the suction cone 46.

Moving up the pipe 10 from the dredging head 2, the thruster device 3 is shown. In this example, the thruster device 3 comprises two thruster tubes 30, but a single one 30 would suffice. Each thruster tube 30 comprises a first thruster aperture (32) at the innermost end of the thruster tube 30 and which is affixed to a sidewall of the pipe 10 around an aperture therein such that there is a relatively fluid tight seal between the thruster tube 30 and its connection with the pipe 10. The thruster tube 30 further comprises a second thruster aperture 33 provided at its outermost end and a wire mesh grill 36 disposed over the internal cross sectional area of the thruster tube 30 proximal to the second thruster aperture 33. A further wire mesh grill 36 is disposed over the internal cross sectional area (i.e. the first thruster aperture 32) of the thruster tube 30 proximal to where it is affixed to the sidewall of the pipe 10 (i.e. proximal to where it is connected around the aperture in the sidewall of the pipe 10). The thruster tube 30 comprises a thruster 34 (not visible in FIG. 1 but visible in FIG. 15*a*) which is disposed between the first thruster aperture 32 and the second thruster aperture 33. In this example, the thruster tube 30 additionally comprises an optional thruster chamber 31 where the thruster 34 is disposed.

In this example arrangement the thruster tube 30 comprises two different diameters of thruster tube 30, a wider diameter region sometimes referred to as a thruster chamber 31 proximal to the second thruster aperture 33, and a narrower diameter tube which forms a constriction. In other examples, the thruster tube 30 may have a constant diameter. FIG. 1 also illustrates a gate valve 35*a*, as an example of an obstruction mechanism. Gate valve cylinders 37 are illustrated as an obstruction mechanism activation means.

FIG. 1 further illustrates the pipe 10 terminating at its (in use) uppermost end where the second aperture 12 is located. It is noted that this uppermost (in use) end of the pipe 10 may provide for an outlet from the pipe 10 during dredging operations, but does not do so during mass-flow excavation operations, as will be described in more detail subsequently. The pipe 10 may be angled at its in use uppermost end 12 as illustrated, but may also be straight from the first (lowermost) aperture 11 to the second (uppermost) aperture 12. FIG. 1 also illustrates handling/protection frames intended to prevent damage to the apparatus and a control unit 5.

Optionally the underwater dredging apparatus 1 further comprises the control unit 5, with which an ROV (not shown) can interface, for example to plug in at least one control line (not shown). Optionally the at least one control line supplies hydraulic power, or optionally the control line supplies electrical power to the control unit 5. Optionally there are at least two control lines and optionally at least one control line supplies hydraulic power and at least one other control line may supply electrical power. Alternatively, both lines supply hydraulic power. Optionally when the at least one control line is securely plugged into the control unit, the underwater dredging apparatus 1 may be controlled remotely, typically by an operator on the vessel at the surface via the ROV.

Preferably there are 3 control lines, 2 of which are hydraulic lines and one electrical control line leading from the ROV to the control unit. The electrical line is preferably an umbilical line providing power, data and/or communications.

Figure 2A:
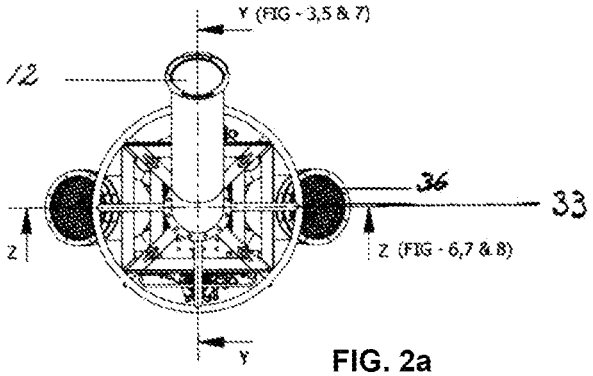
FIG. 2*a* shows a view of the example apparatus of FIG. 1.
Figure 2B:
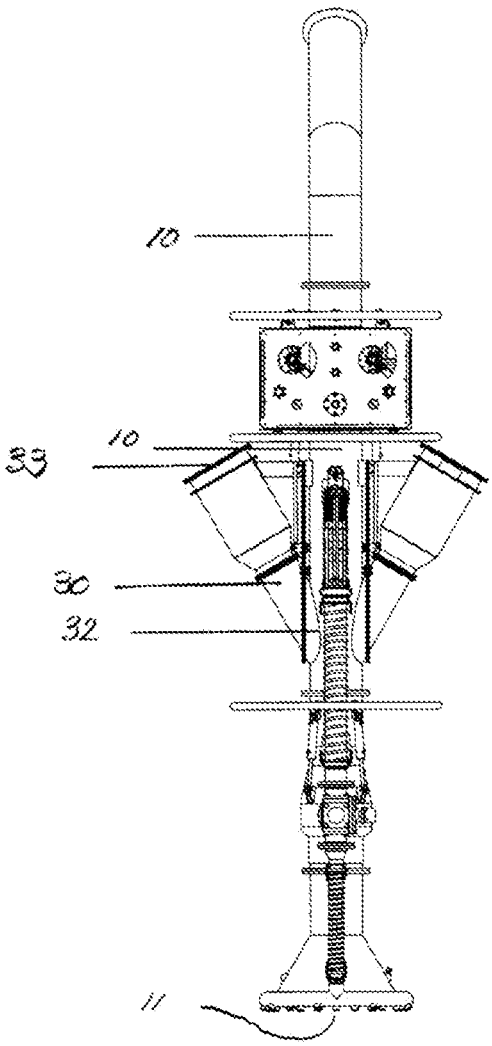
FIG. 2*b* shows a view of the example apparatus of FIG. 1.
Figure 2C:
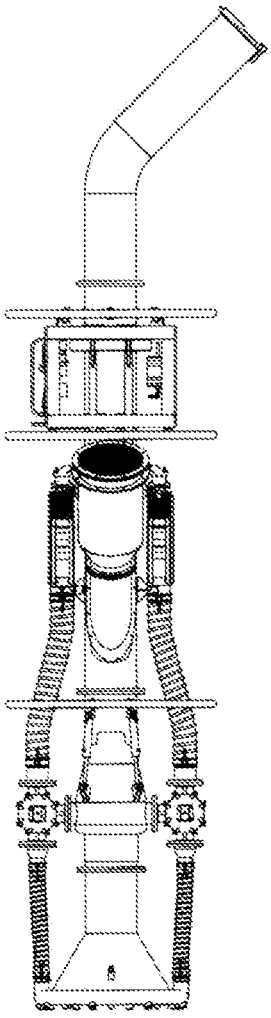
FIG. 2*c* shows a view of the example apparatus of FIG. 1.

FIGS. 2*a*, 2*b* and 2*c* illustrate the same example apparatus 1 for underwater dredging as FIG. 1, but in plan and elevation. In FIG. 2*a*, the second thruster aperture 33 and wire mesh grill 36 are more clearly represented than on the perspective view of FIG. 1. FIG. 2*b* also more clearly illustrates that the thruster tubes 30 are angled away from the centreline of pipe 10 such that the second thruster aperture 33 is disposed some distance away from the pipe 10. In this example, each thruster tube 30 is angled away from the pipe 10 (typically in the region of 15 to 75 degrees and more preferably around 30 degrees outwardly from their uppermost end compared with the longitudinal axis of the pipe 10) such that fluid drawn into the second thruster aperture 33 and accelerated toward the first thruster aperture 32 by the thruster 34 would enter the pipe 10 directed toward the first aperture 11. It is advantageous that said fluid flow enter the pipe 10 directed toward the first aperture 11 during mass-flow excavation because it promotes additional fluid to flow in the pipe 10 from the second aperture 12 to the first aperture 11 and thereby enhance or increase the mass flow excavation operation. In some embodiments, the thruster tube 30 may be other than straight, for example it may be curved.

Figure 3:
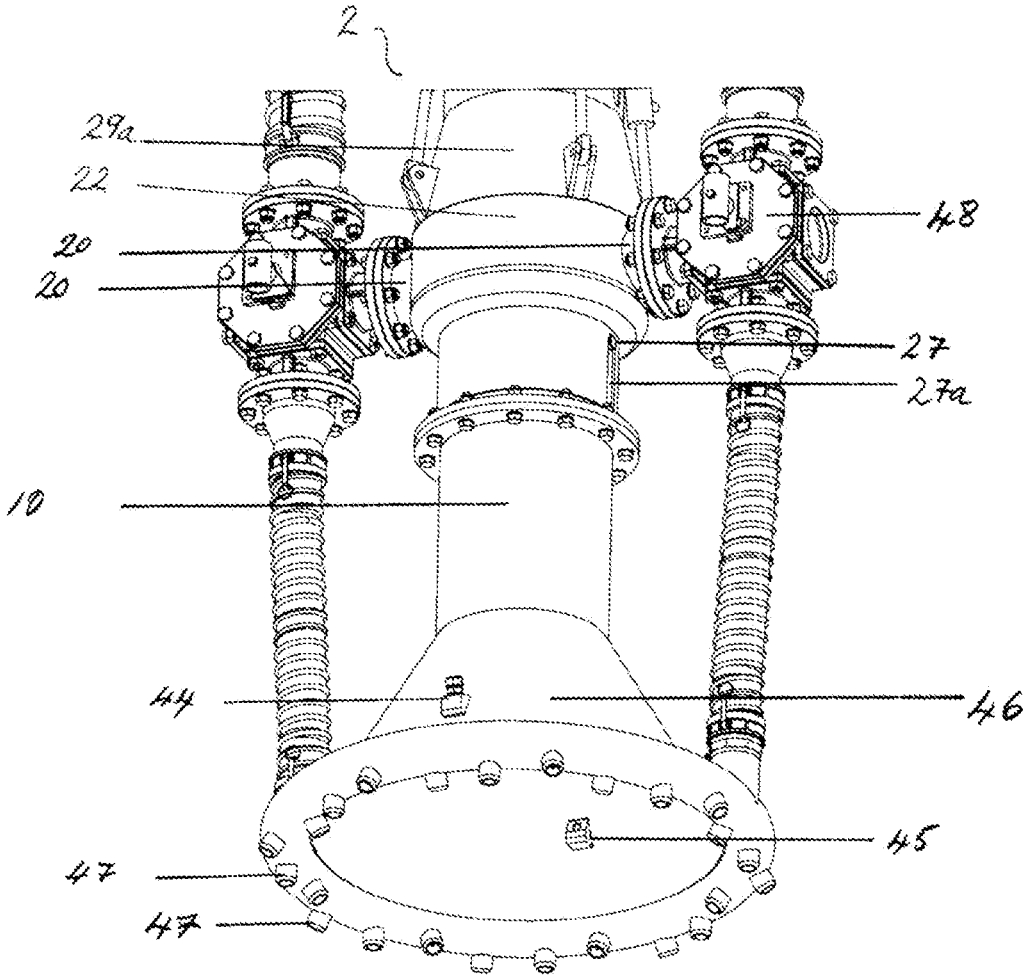
FIG. 3 shows a perspective view of an example suction cone (incorporating airlift nozzles), dredging head and flow control valves of the example apparatus of FIG. 1.

FIG. 3 illustrates a closer up/more detailed example end section of the apparatus of FIG. 1. The optional suction cone 46 is shown which may be advantageous during dredging operations for drawing additional materials into the pipe 10. The circumferentially arranged jetting heads 47 can also be advantageous for loosening materials forming the substrate to assist either dredging or mass-flow excavation. The suction cone 46 in this example also comprises an airlift connection 44 with air lift nozzle 45 which can advantageously be used underwater to assist the passage of materials through the pipe 10 when the suction cone 46 is facing downwards toward the substrate. The dredging head 2 is also partly illustrated in FIG. 3. In this example, the dredging head 2 comprises two laterally arranged inputs 20, but only one is required and more are optional.

The optional plenum alignment key 27 and plenum alignment slot 27*a* are also shown as part of this example, which is advantageous when a first obstruction mechanism is activated (to obstruct a flow) by translation of at least one component of the dredging head 2; e.g. when the translation comprises an axially sliding displacement of the dredging head 2 or key components of it, the plenum alignment key 27 and plenum alignment slot 27*a* provide a means for maintaining correct rotational alignment of dredging head output(s) 21 and first sidewall aperture(s) 13.

Optional flow control valves 48 are also illustrated. The flow control valves 48 may direct fluid flow to the jetting heads 47 and/or the dredging head 2 (the latter via the laterally arranged inputs 20), which supports flexibility of operation. It is also advantageous to use flow control valves 48 to allow automation of fluid flow control to facilitate rapid switching between operational modes.

Figure 4:
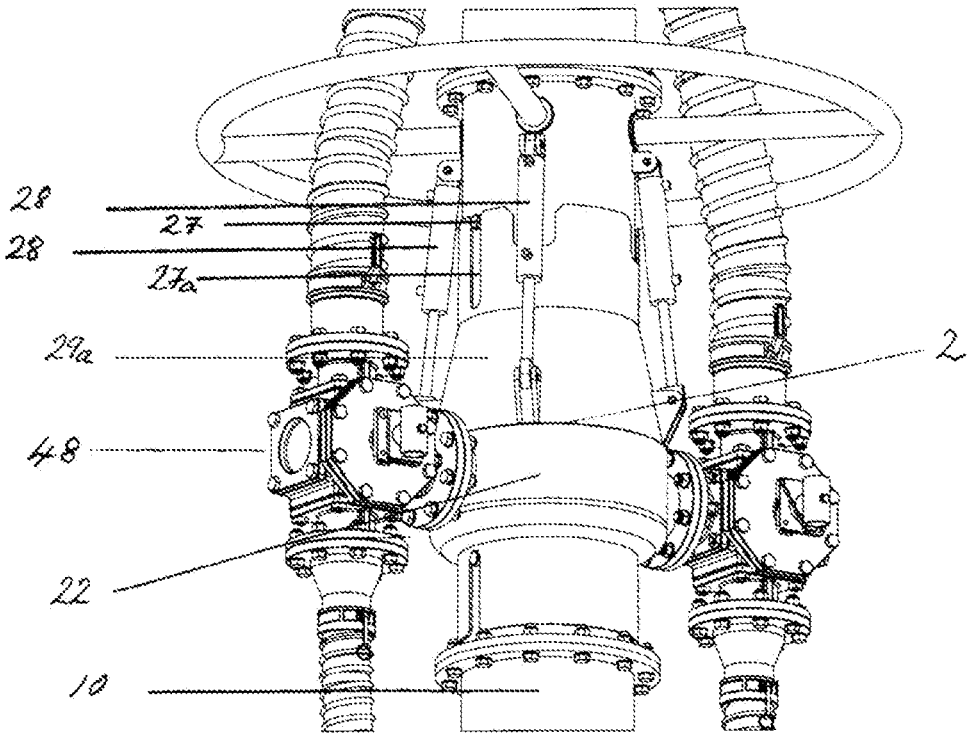
FIG. 4 shows a perspective view of an example dredging head and flow control valves of the example apparatus of FIG. 1.

FIG. 4 illustrates the first example dredging head 2 for the underwater dredging apparatus 1. In this first example, the dredging head 2 uses translation of a part of the dredging head 2 relative to the pipe 10 to activate and deactivate an obstruction mechanism 23 (not shown). This movement can be controlled by the illustrated plenum chamber cylinders 28 which can advantageously be controlled automatically. It can also be advantageous for embodiments using translation of a part of the dredging head 2 relative to the pipe 10, to employ an alignment mechanism, e.g. a plenum alignment key 27 and slot 27*a*, to ensure the dredging head 2 remains properly aligned (particularly rotationally) during movement and operation. This may be preferable when the dredging head 2 comprises the venturi ring 25 containing a plurality of venturi 24 (not shown in FIG. 4 but shown in FIG. 7*b*) aligned to a plurality of sidewall apertures 13 (not shown in FIG. 4 but shown in FIG. 7*b*), where each venturi 24 comprises an aperture formed through the venturi ring 25 and where the said aperture tapers from a wider diameter end (which is closest to the laterally provided inputs 20) to a narrower diameter end (which is furthest away from the laterally provided inputs 20).

Figure 5:
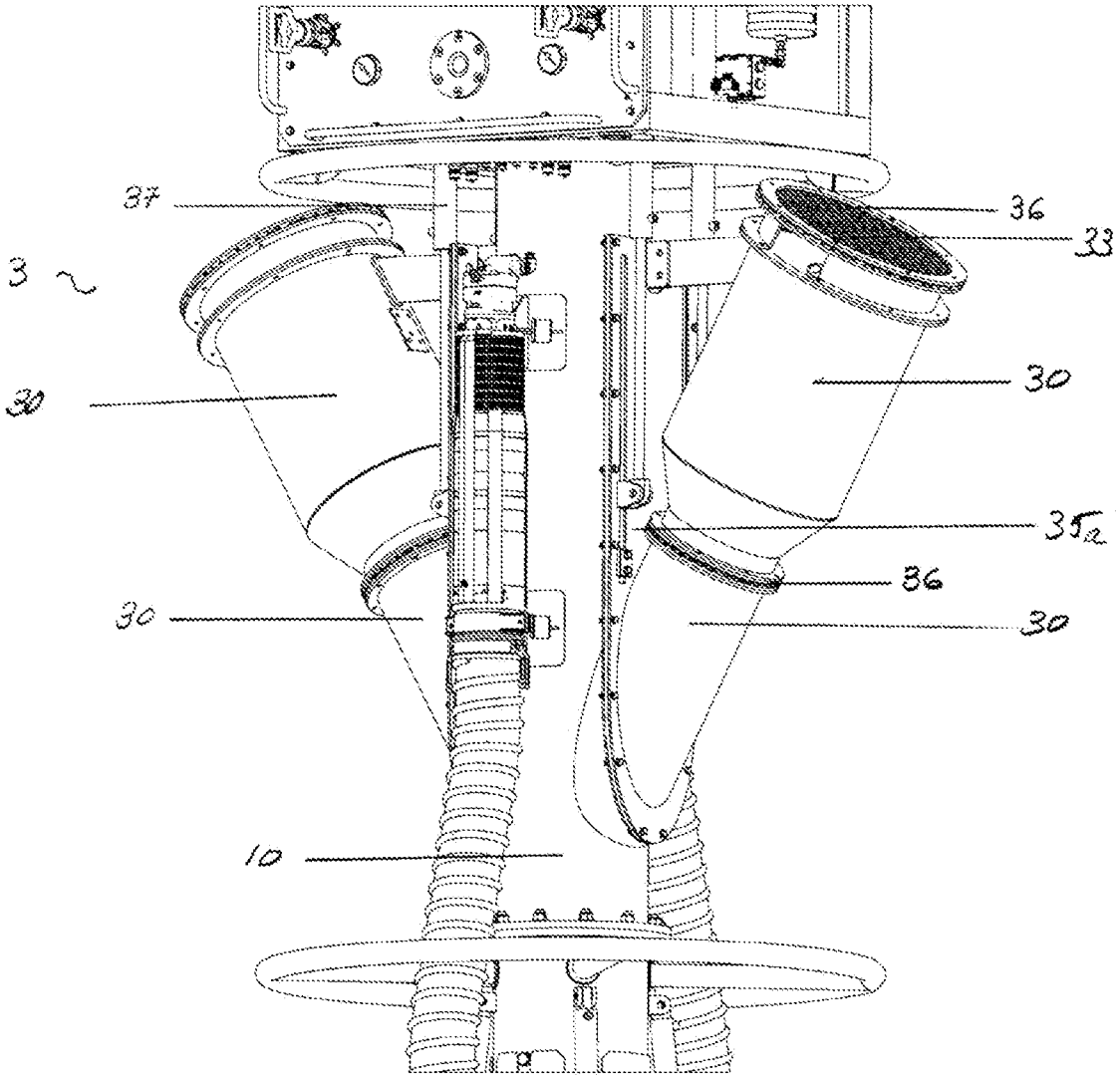
FIG. 5 shows a perspective view of an example thruster device of the example apparatus of FIG. 1.

FIG. 5 illustrates an example thruster device 3 as used in the underwater dredging apparatus 1 of FIG. 1. This figure shows more clearly, an optional wire mesh grill 36 over the second thruster aperture 33. It is not required that one or more wire mesh grills be fitted to the thruster tubes, but it is advantageous to protect the thrusters 34 from particles, especially large particles, during dredging and/or mass-flow excavation. Other means for protecting the thrusters 34 from damage by particles comprised in the fluid flow, e.g. filters of various kinds, may optionally be employed.

Figure 12A:
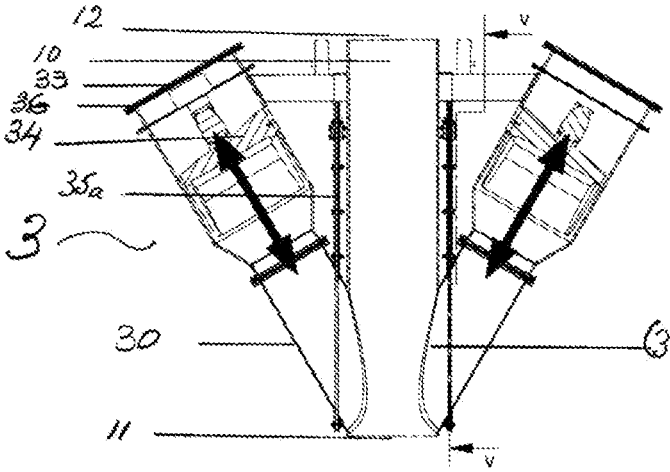
FIGS. 12*a*-12*d* show cross-sectional elevations of the example thruster device of FIG. 5.
Figure 12B:
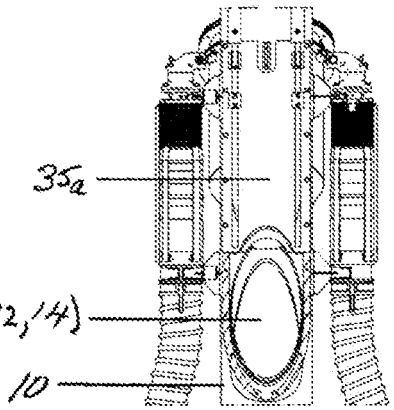
Figure 12C:
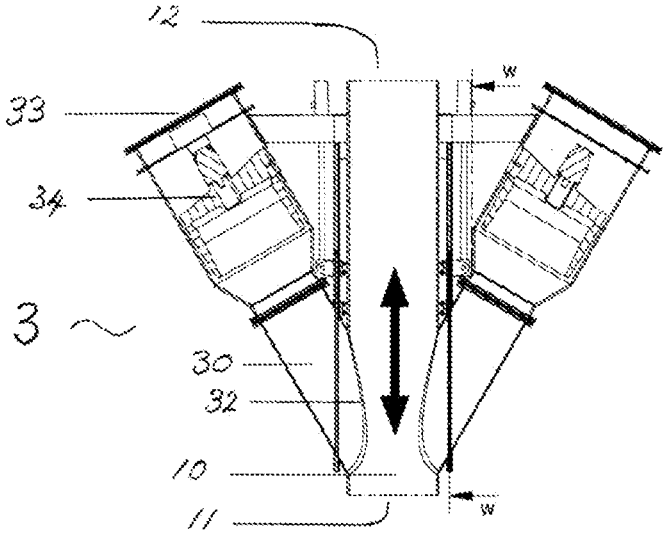
Figure 12D:
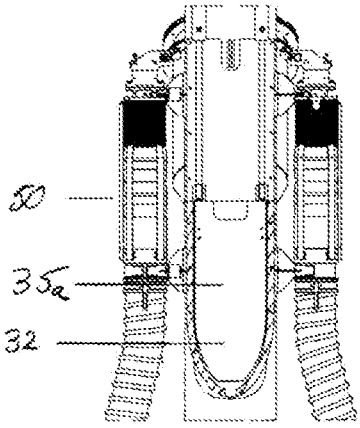

It may also be advantageous to protect the thruster 34 during dredging operations by employing an obstruction mechanism 35 to reduce or prevent fluid flow into the thruster tube 30. It is particularly advantageous to prevent suspensions of particles and especially large particles from entering the thruster tube 30 during this mode of operation. Any suitable means to achieve this advantage may be used, one such example is a valve such as a gate valve 35*a* which is illustrated in FIG. 5. The gate valve 35*a* may be activated (i.e. arranged to block fluid flow between the pipe 10 and the thruster tube 30) by hydraulic cylinders 37 (shown in part in FIGS. 5 and 12*b*) which can advantageously be used to automatically control the obstruction mechanism and facilitate a rapid change of operating mode. In this example, the gate valve 35*a* slides in a channel from the inactive position to an active position where it is held over the internal cross section of the thruster tube 30 proximal to the first aperture 32. However, the thrusters 34 may provide the primary or secondary motive force for dredging and usually provide the primary motive force for mass-flow excavation, all of which require fluid communication between the thruster tube 30 and the pipe 10, hence, it is advantageous if the second obstruction mechanism (which in this example are in the form of the gate valves 35) is reversible and can be used in conjunction with the optional wire mesh grill(s) 36. All disclosed thruster devices 3 are interchangeable, hence the same reference numerals are used throughout.

Figure 6:
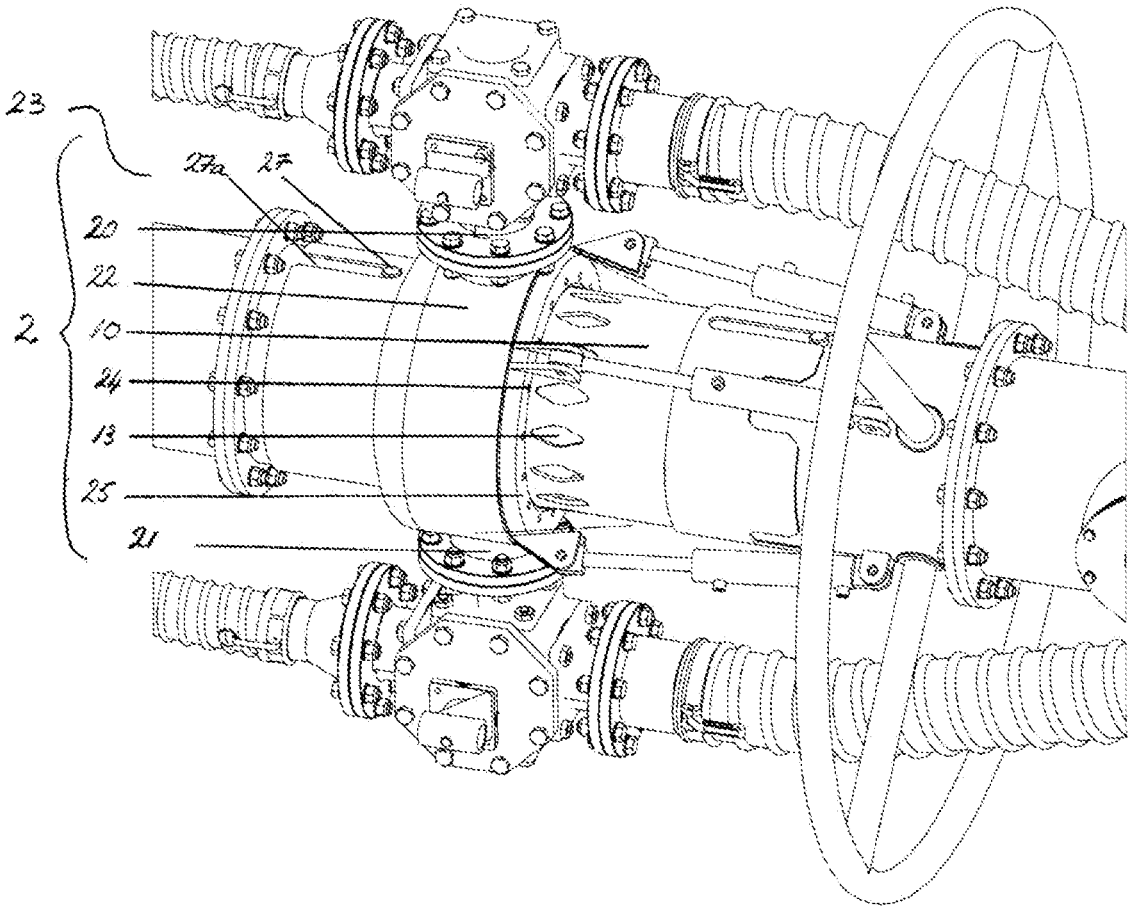
FIG. 6 shows a perspective view including cutaway section, of the example dredging head and flow control valves of FIG. 4.
Figures 7A, 7B, 7C:
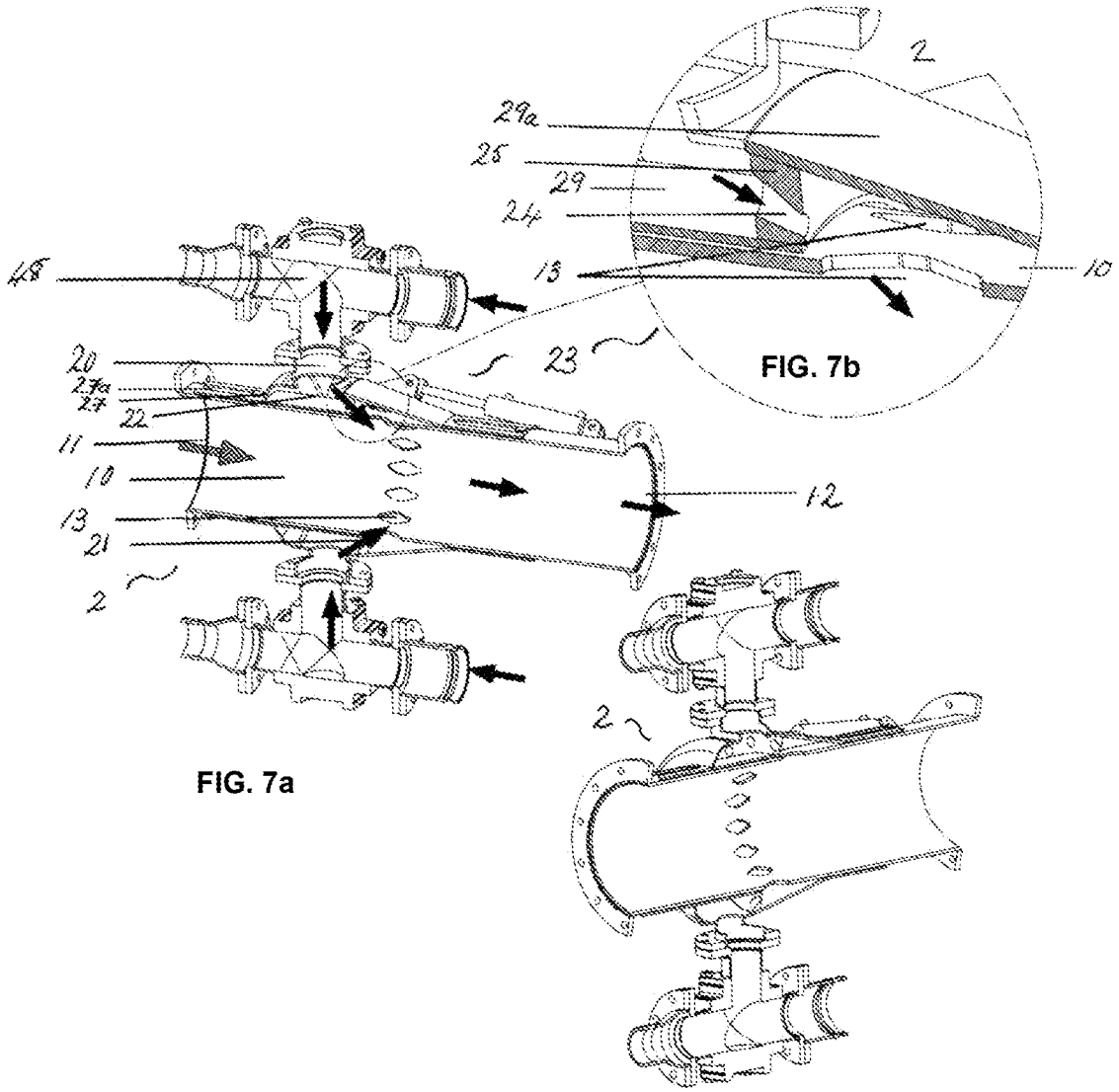
FIG. 7*a* shows a perspective view in cross section of the example dredging head of FIG. 6 and shown with arrows indicating the flow of fluid during a first dredging mode of operation in which the dredging head is used to assist the dredging operation using the venturi effect (and as also shown in FIG. 13).
FIG. 7*b* shows a detailed close up perspective view of a portion of the dredging head of FIG. 7*a*.
FIG. 7*c* shows a perspective view in cross section of the dredging head of FIG. 7*a*, but viewed from the other end compared with the view shown in FIG. 7*a*.

FIG. 6 illustrates the first example dredging head 2 using translation means to activate and deactivate a first obstruction mechanism 23. In this figure, the tapered sleeve 29*a* is omitted in order to allow the venturi ring 25 and first sidewall apertures 13 to be seen. In this example, each of the venturi 24 are preferably axially aligned with a respective first sidewall aperture 13 which in FIG. 7*a* are unobstructed as illustrated. If the dredging head 2 and in particular the plenum chamber 22 were positioned such that the plenum alignment keys 27 were at the other end of their plenum alignment slots 27*a*, then the plenum chamber 22 would cover the first sidewall apertures 13 and reverse flow into the dredging head 2 would be prevented. It is advantageous to prevent reverse flow, i.e. fluid flow into the output 21 of the dredging head 2 from the pipe 10, because particles within the fluid may interfere with operation of the dredging head 2. Hence, it is an object of the first obstruction mechanism 23 to protect the dredging head 2 from damage and/or operational impairment due to reverse flow.

It is advantageous that the output 21 of the dredging head 2 is configured to issue a fluid flow therefrom into the pipe 10 via the first sidewall aperture 13. It is further advantageous for dredging operations that said fluid flow be directed toward the second aperture 12 because this promotes fluid flow in the pipe 10 from the first aperture 11 to the second aperture 12 as explained below. It is advantageous that the first obstruction mechanism 23 be reversible such that the dredging head 2 is in fluid communication with pipe 10 when being used, e.g. during dredging operations, and is protected from reverse flow when not in use, e.g. during mass flow excavation.

FIG. 7 illustrates the first example of dredging head 2 for use in the underwater dredging apparatus 1 and which uses the same translation means to activate and deactivate an obstruction mechanism 23 as shown in FIG. 6 and detailed above. In FIG. 7, the obstruction mechanism 23 is again shown deactivated and the dredging head 2 is operational. When in use, an example process may involve a fluid flow being received at an input 20 of the dredging head 2. FIG. 7*a* illustrates this as being via a flow control valve 48, but this is optional. The fluid flow may come from any source, for example, a locally positioned pump 50 as illustrated in FIG. 1, an ROV (not shown) or more remote source such as a surface vessel (not shown). The dredging head 2 issues a fluid flow into the pipe 10 via a first sidewall aperture 13. As indicated by the black arrows in FIG. 7*a* the fluid flow enters the pipe 10 directed toward the second aperture 12. Fluid would enter the pipe 10 with a fluid flow velocity and/or pressure greater than the ambient fluid resting in the pipe 10.

A simple model may be adopted to facilitate understanding of how it works, for example, consider the situation where fluid in the pipe 10 is initially stationary and then fluid flowing into the pipe 10 (from the laterally arranged input 20 through the venturi 24 and via the first sidewall apertures 13) is directed toward the second aperture 12. The said fluid flow will exert a force on the fluid ahead of it which will propel it toward the second aperture 12. However, as the fluid flow in the pipe 10 between the first sidewall aperture 13 and the second aperture 12 is now flowing away from the stationary fluid in the pipe 10 between the first aperture 11 and the first sidewall aperture 13, a low pressure zone is created between the incoming fluid and the stationary fluid which will exert a force on the stationary fluid drawing it along the pipe 10 from the first aperture 11 toward the second aperture 12. Hence, by introducing fluid flow into the pipe 10 directed toward the second aperture 12, the dredging head 2 is promoting, i.e. motivating, fluid flow in the pipe 10 from the first aperture 11 to the second aperture 12. The principles behind this simplified explanation are well known in the art and the skilled person will understand how to generalise this approach.

FIG. 7*a* shows an orientation to assist in understanding of its basic principles, but in a dredging operation the apparatus 1 would ordinarily be oriented more toward the vertical such that the first aperture 11 is angled toward the sea bed, a wide range of angles may be applied as the terrain requires, and optionally pipe 10 is angled approximately orthogonal to the seabed. When the first aperture 11 is positioned close to the seabed, the flow of fluid into aperture 11 during a dredging operation draws material from the seabed into aperture 11 along with it (illustrated by the hatched arrow). The fluid comprising material from the seabed then travels along pipe 10 toward the second aperture 12 where optionally it is ejected into the local environment. The pipe 10 may optionally be telescopic and allow for its length to be changed in order to facilitate flexibility when dealing with various seabed terrains.

FIG. 7*b* shows an enlarged section of FIG. 7*a* illustrating part of an example dredging head 2 and pipe 10 in cross section. A cross section of a venturi 24 forming part of a venturi ring 25 and a first sidewall aperture 13 are shown with flow arrows indicating the direction of fluid flow when in use during a dredging operation. While a single sidewall aperture 13 will achieve the effect of promoting fluid flow in the pipe 10 as disclosed above, it has been found to be advantageous to use a plurality of sidewall apertures 13 (and preferably a plurality of respective venturi 24) because it can provide a high flow rate into the pipe 10 while the dredging head 2 remains small. It can also provide a uniform flow within the pipe 10 which is advantageous for transporting material from the substrate along the pipe 10. If a plurality of sidewall apertures 13 are used, it is preferable to distribute them evenly around the circumference of the pipe 10. e.g. if two sidewall apertures 13 are used they would be placed 180 degrees apart (i.e. opposite each other), and if 3 sidewall apertures 13 are used they would be placed 120 degrees apart around the circumference of the pipe 10.

Provided the dredging head 2 issues a fluid flow into the pipe 10 via a first sidewall aperture 13 such that the fluid flow enters the pipe 10 directed toward the second aperture 12, fluid flow in the pipe 10 will be suitable for a dredging operation. It has been found to be advantageous to use venturi 24 to increase the flow rate of the fluid prior to it entering the pipe 10. This promotes a high flow rate and the venturi 24 can produce a jet of fluid which can pass through the centre of a sidewall aperture 13 leading to increased efficiency because losses due to fluid flow impacting the sidewall of pipe 10 surrounding the aperture 13 are reduced. When a plurality of sidewall apertures 13 are used it is advantageous to employ a venturi ring 25 comprising venturi 24 aligned with each sidewall aperture 13 to achieve the above identified efficiencies.

FIG. 7*c* shows the same components as FIG. 7*a* from a different angle.

Figure 8:
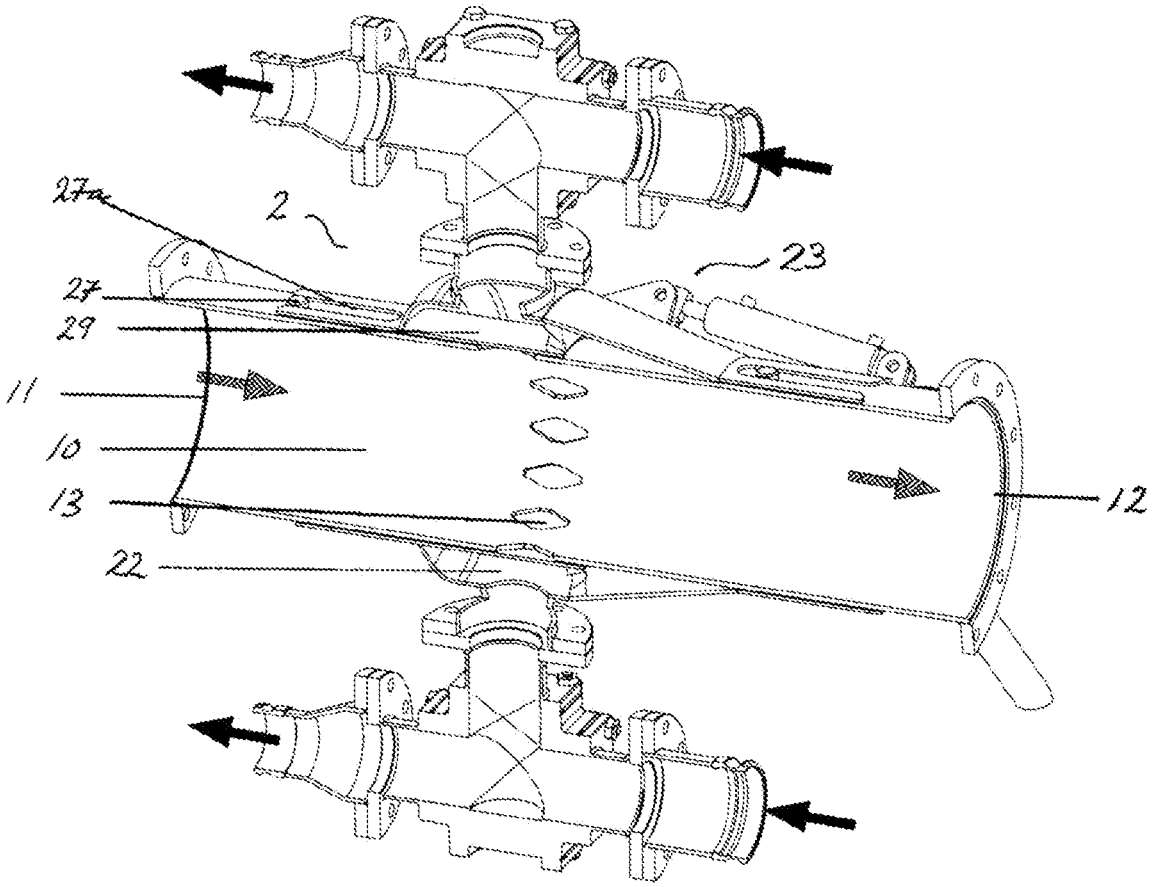
FIG. 8 shows a perspective view in cross section of the example dredging head and flow control valves of the example apparatus of FIG. 1, and shown with arrows indicating the flow of fluid during a second dredging mode of operation in which the dredging head is not used to assist the dredging operation using the venturi effect.

FIG. 8 illustrates the first example dredging head 2 of FIGS. 7*a* to 7*c* but this time is shown in FIG. 8 with the obstruction mechanism 23 activated, i.e. reverse flow into the dredging head 2 is prevented. It can be seen that the plenum chamber 22 which is circumferentially disposed around the pipe 10 is acting as a sleeve in this first example 2 such that it (and in particular the innermost circumference of the venture ring 25) is blocking or covering over the sidewall apertures 13 in the position shown. Comparison with FIG. 7 shows the same arrangement with the dredging head 2 positioned such that the plenum chamber 22 is not obstructing the sidewall apertures 13. In this example the obstruction mechanism 23 (and particularly the plenum chamber 22 thereof) is activated by translation of the dredging head 2 relative to the pipe 10, i.e. the plenum chamber 22 (and the venturi ring 25 which is secured thereto at the approximate midpoint thereof) slides along the pipe 10 guided by the plenum alignment keys 27 and plenum alignment slots 27*a* until the co-axially arranged sleeve portion 29 and/or the venturi ring 25 cover over the outermost side of the sidewall apertures 13 and thereby prevent any further fluid flowing therethrough. Other mechanisms may be employed to provide the blocking action of the obstruction mechanism 23 and activate said blocking action, for example, venturi 24 could be misaligned with the sidewall apertures 13 by a helical, or turning movement of the dredging head 2 relative to the pipe 10.

FIG. 8 illustrates a combination of a jetting and dredging operation, but the dredging head 2 is not being used on this occasion, hence the first obstruction mechanism 23 is active. Instead, the thrusters 34 are being used to draw fluid up the pipe 10 from the first aperture 11, toward the second aperture 12 and into the thruster tubes 30. Consequently, the second obstruction mechanism 35 (see FIG. 12*a*) is not active. The flow control valves 48 can be configured to a) pump fluid down to the jetting heads/nozzles 47 in order to operate a jetting only operation; or
b) pump fluid through the laterally arranged inputs 20 of the dredging head 2 only; or
c) can pump fluid through both a) and b) together at the same time.

The latter c) may be facilitated by one flow control valve 48 directing fluid flow to the jetting nozzles 47 and one flow control valve 48 directing fluid flow to the laterally provided inputs 20 of the dredging head 2. In this latter c) example, the first obstruction mechanism 23 would be inactive.

Figure 9:
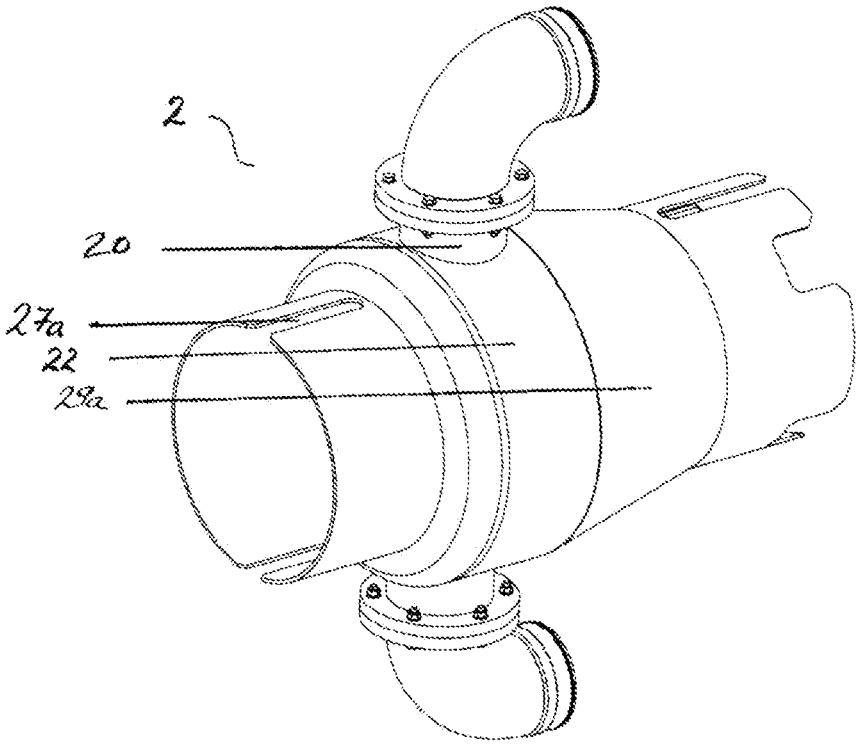
FIG. 9 shows a perspective view of the example dredging head of FIGS. 6. and 7*a*, but with elbows fitted to the inputs instead of flow control valves.
Figure 10A:
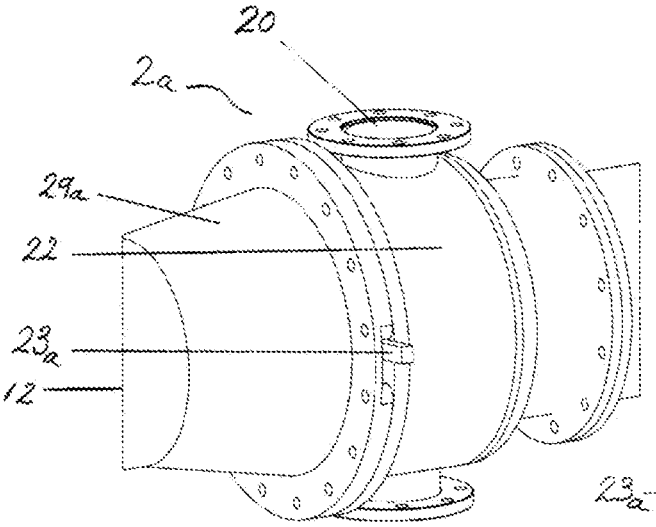
FIG. 10*a* shows a perspective view of a second example dredging head for use with the example apparatus of FIG. 1 as an alternative to the first example dredging head of FIGS. 6. and 7*a*.
Figure 10B:
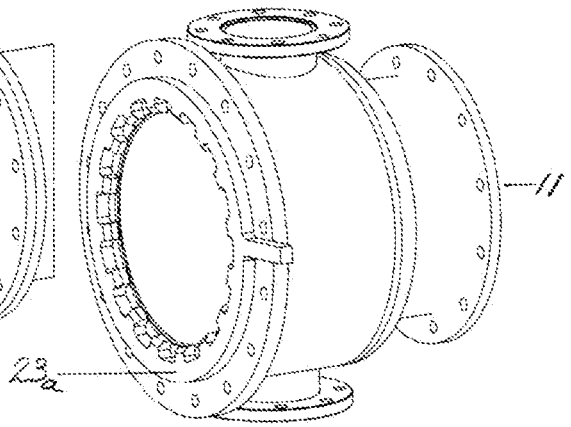
FIG. 10*b* shows a perspective view of a second example dredging head for use with the example apparatus of FIG. 1 as an alternative to the first example dredging head of FIGS. 6. and 7*a*
Figure 10C:
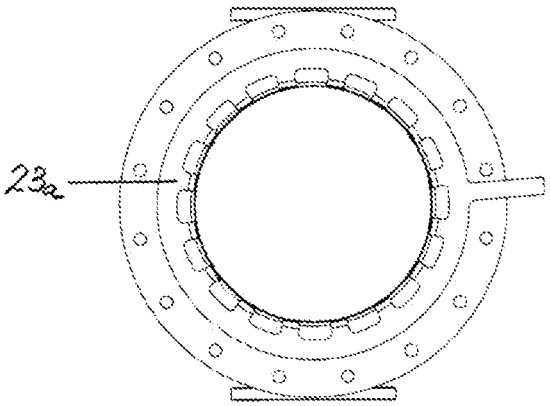
FIG. 10*c* shows an elevation view of a second example dredging head for use with the example apparatus of FIG. 1 as an alternative to the first example dredging head of FIGS. 6. and 7*a*.
Figure 10D:
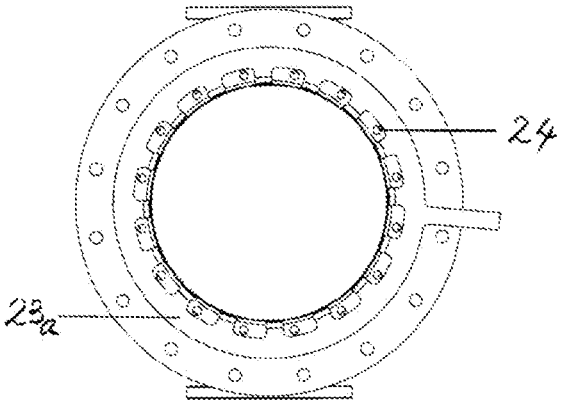
FIG. 10*d* shows an elevation view of a second example dredging head for use with the example apparatus of FIG. 1 as an alternative to the first example dredging head of FIGS. 6. and 7*a*.

FIG. 9 illustrates an example dredging head 2 as used in the underwater dredging apparatus 1 of FIG. 1. It has plenum alignment slots 27*a* and two inputs 20. However, the number of inputs 20 may be chosen to be any suitable number. In this example the dredging head 2 is not attached to flow control valves 48, but does have connection elbows. All disclosed dredging heads 2; 2*a* are interchangeable, hence the same reference numerals for their common components are used throughout.

FIG. 10 illustrates a second example of a dredging head 2*a* as used in the underwater dredging apparatus 1 of FIG. 1. In this example the obstruction mechanism 23 comprises a slotted ring 23*a* which can be rotated to block the venturi 24. FIG. 10*c* shows the slotted ring 23*a* in its active position, i.e. preventing or reducing reverse fluid flow through the venturi 24. FIG. 10*d* shows the slotted ring 23*a* in its inactive position, i.e. not impeding fluid flow.

Figure 11:
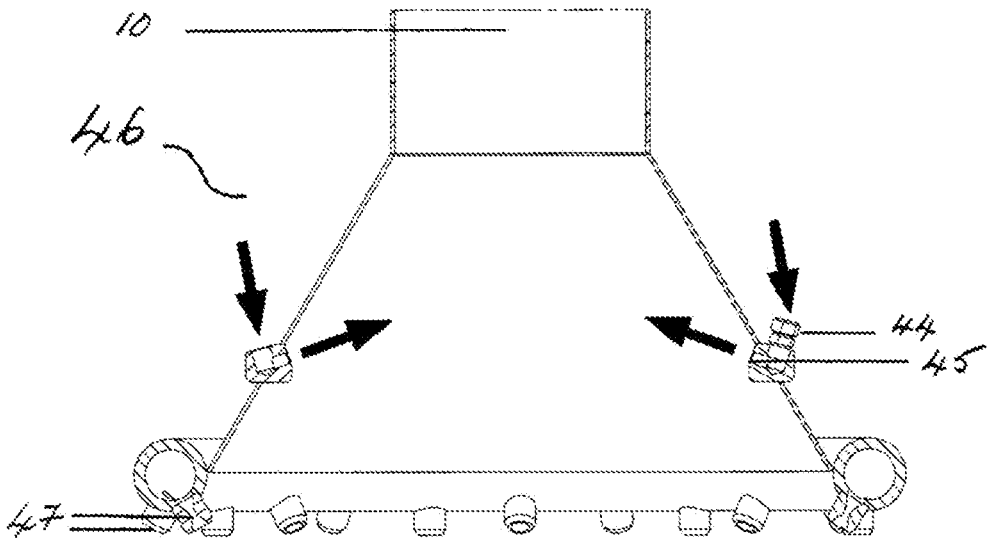
FIG. 11 shows an elevation view of the example suction cone (incorporating airlift nozzles) of FIG. 3 and shown with arrows indicating the flow of air during an air lift assisted dredging operation.

FIG. 11 illustrates an example of an optional suction cone 46 but which is used in the apparatus 1 as shown in FIG. 1. In this example, jetting heads (nozzles) 47 can be seen circumferentially arranged around the base of the suction cone 46. The suction cone 46 may be affixed to a pipe 10 if desired, and the length of pipe 10 may be chosen to best suit the circumstances. This example also shows optional air lift nozzles 45 and connectors 44. When in use, a gaseous fluid is input at the air lift connection 44 and is emitted from the air lift nozzle 45. Any suitably available gaseous fluid may be used including air, nitrogen etc. As the apparatus 1 is underwater during use, the gaseous fluid will travel upwards away from the bed and toward the surface, as it does so it expands but also creates a low pressure region in its wake which exerts a force on the fluid behind it, drawing the fluid up the pipe 10. When used with an apparatus 1 for underwater dredging with the suction cone 46 directed toward and proximal to the bed, it has been found to be advantageous in assisting the transport of fluid suspensions through the pipe 10 from the first aperture 11 to the second aperture 12 with greatest effect found when the pipe 10 is approximately vertical.

FIG. 12 shows cross-sectional elevations of an example thruster device 3 as for example used in the underwater dredging apparatus 1. In this example, the thruster device 3 comprises an obstruction mechanism 35 configured to deter fluid flow between the pipe 10 and the thruster tube 30, and the obstruction mechanism comprises a gate valve 35*a*. In FIGS. 12*a* and 12*b* the gate valve 35*a* is inactive, i.e. open, thereby allowing fluid flow between the pipe 10 and the thruster tube 30 unimpeded. In FIGS. 12*c* and 12*d* the gate valve 35*a* is active, i.e. closed, thereby preventing or reducing fluid flow between the pipe 10 and the thruster tube 30. In FIGS. 12*a* and 12*c* the thruster 34 is also shown. In this example, the gate valve 35*a* is contained within guide channels. This is advantageous for smooth operation and to ensure an active gate valve 35*a* is able to withstand pressures exerted between the pipe 10 and thruster tube 30 during use. It can also be seen from the figures, that the thruster tube 30 is affixed to the pipe 10 such that it is surrounding a sidewall aperture 14 formed in the pipe 10.

The thrusters 34 may be arranged to operate such that they promote (cause) fluid to flow from the thruster tube 30 into the pipe 10 and/or from the pipe 10 into the thruster tube 30. When the thruster 34 is promoting fluid flow from the thruster tube 30 into the pipe 10, fluid is drawn into the thruster tube 30 at the second thruster aperture 33 and issued into the pipe 10 from the first thruster aperture 32. Because the thruster tube 30 is angled such that the second thruster aperture 33 is held away from the pipe 10, the fluid flow it issues into the pipe 10 will be directed toward the first aperture 11. Consequently, the same simple model as given above regarding promoting fluid flow in the pipe 10 for dredging is applicable here by analogy.

Provided the fluid flow is directed toward the first aperture of the pipe 10, mass-flow excavation will be enabled. However, improved results are found when the thruster tube is angled at less than 80 degrees from the pipe 10, when measured from the centreline of the pipe 10 to the centreline of the thruster tube 30. Indeed as the angle is reduced to 60 degrees efficiency improves further, as it does again at 40 degrees. The optimum angle is 30 degrees, but even 20 degrees or less gives good results. As this angle is less than 90 degrees, and the thruster tube 30 issues fluid flow into the pipe 10 directed toward the first aperture 11, then the intersection point of the centreline of the pipe 10 and the centreline of the thruster tube 30 is positioned between the centreline of the second sidewall aperture 33 and the first aperture 32. When measuring the angle, the centreline of the thruster tube 30 is taken from the point where the thruster tube 30 is affixed to the pipe 10 as the angle the fluid flow enters the pipe 10 is relevant even when curved thruster tubes 30 are used.

In this mode of operation the fluid intake is directly from the ambient environment which may be a particle suspension, may contain dissolved or entrained gasses or even biological materials during operation. Most of these things should not impact significantly on performance of the system or apparatus 1, but large particles can cause damage to thruster 34 impellers so wire mesh grills 36 may be fitted at either side of the thruster 34 to provide protection from large particles within the fluid flow travelling in either direction, other filter means may also be employed. Excessive amounts of particulate matter, large or small can still be damaging to the thrusters 34. This can be mitigated to some extent by angling the thruster tube 30, and specifically the second thruster aperture 33, away from the bed. This greatly reduces the amount or particulate matter, and especially large particles, entering the thruster tubes 30.

When the thruster 34 is promoting fluid flow from the pipe 10 into the thruster tube 30, it draws fluid into the thruster tube 30 from the pipe 10 via the second sidewall aperture 14 and the first thruster aperture 32. The fluid then passes from the thruster tube 30 into the environment via the second thruster aperture 33. This fluid flow may be used in isolation to provide a dredging process or operation, or used in addition to a dredging head 2,2*a* to provide an improved dredging operation performance. Dredging operations can also introduce large quantities of materials into the pipe 10, and so any potential for damage to thrusters 34 because of particles in the fluid in this dredging mode may be mitigated by a wire mesh grill 36 or other filtering means, and when thrusters 34 are not required to assist the dredging operation, an obstruction mechanism 35 (optionally, a gate vale 35 in the example of FIG. 12) may be used to isolate the thrusters 34 from the fluid flow within the pipe 10.

Figure 13:
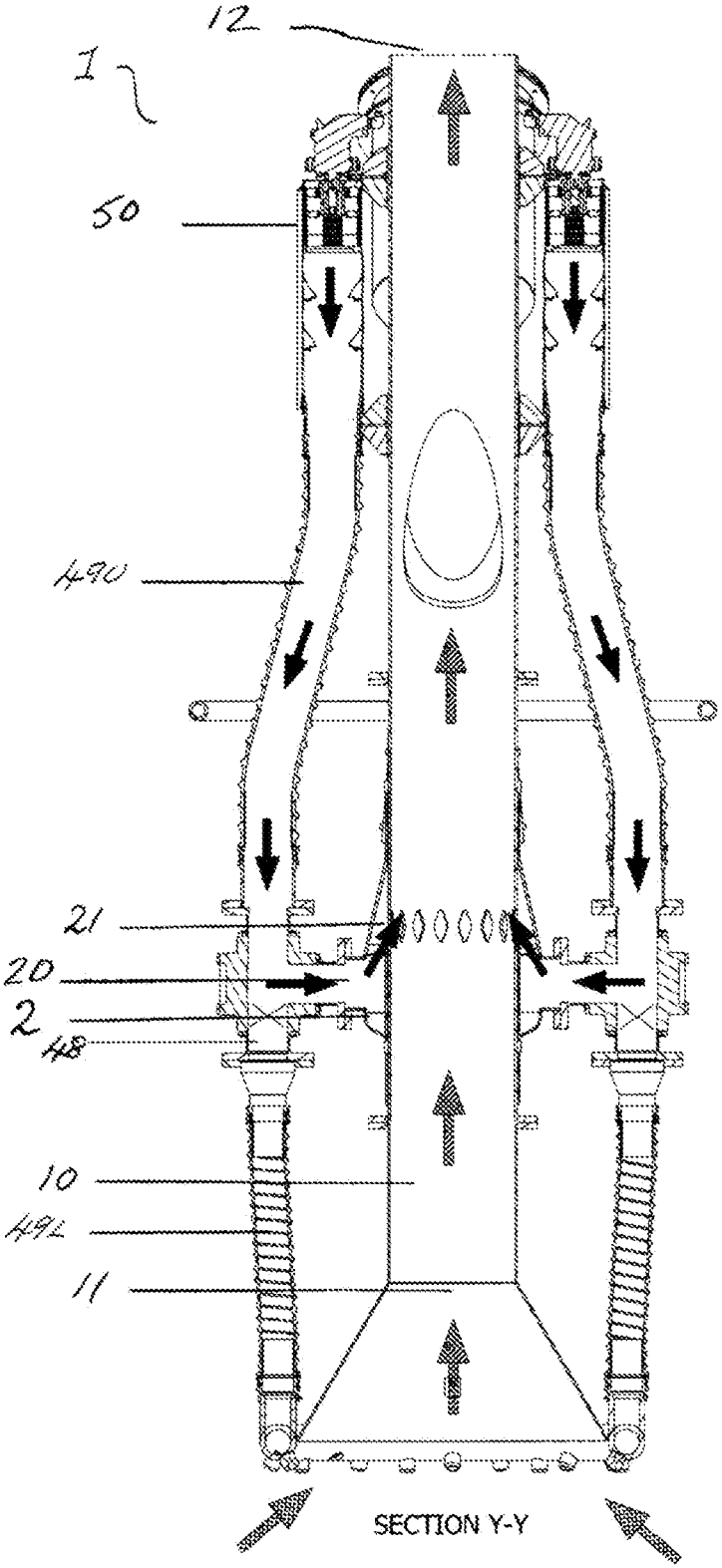
FIG. 13 shows a cross-sectional elevation of the example apparatus for underwater dredging of FIG. 1 configured for dredging operations.
Figure 14:
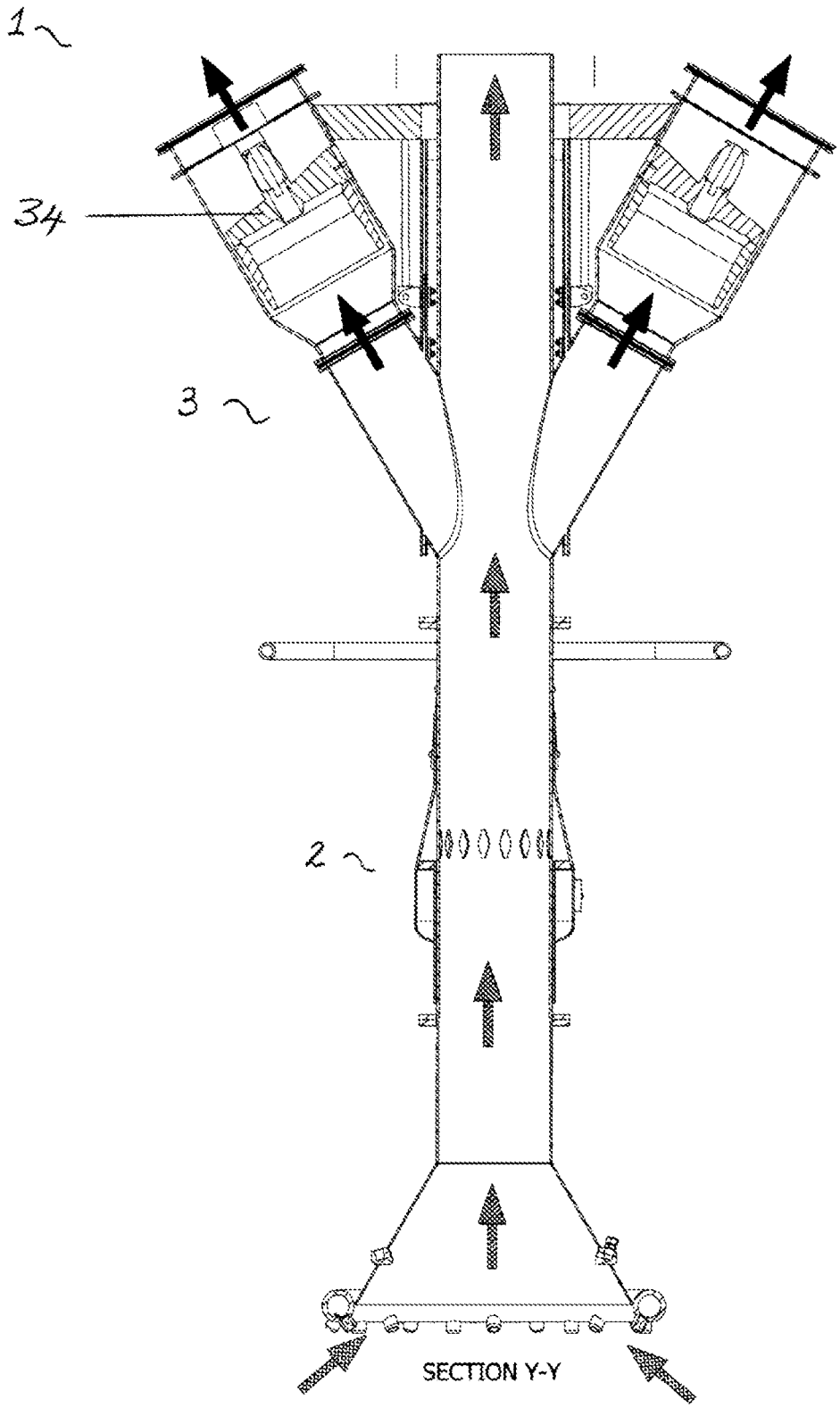
FIG. 14 shows another cross-sectional elevation (but with the apparatus rotated through 90 degrees compared to that of FIG. 13) of the example apparatus of FIG. 1 configured for dredging operations using the thrusters of FIG. 5.

Use of Apparatus 1 in a Dredging Operation—FIGS. 13 & 14

FIG. 13 illustrates an example apparatus 1 operating in dredging mode. In this example, a fluid flow is provided by optional pumps 50 mounted on the apparatus 1. The fluid passes via the pumps 50 to the dredging head input 20. The dredging head 2 then (via the venture 24 and first sidewall apertures 13) issues a fluid flow into the pipe 10 directed toward the second aperture 12. This causes fluid to flow in the pipe 10 from the first aperture 11 to the second aperture 12. When the first aperture 11 is placed proximal to the bed, the fluid flowing into it draws in material from the bed, this results in a fluid suspension comprising any manner of particles and entrained gasses etc. The resultant fluid then travels along the pipe 10 and is ejected at the second aperture 12. This could, for example, be into another pipe or tube (not shown) to be transported elsewhere or simply ejected into the local environment. The length of pipe 10 can be selected to suit the operating environment. Each section of the pipe 10 may be selected as required. For example, the length may be selected to improve reach from the dredging head 2 into a channel or pile (not shown), to move the waste/spoil from a dredging operation further away from where it was removed, or even to change the distance between the dredging head 2 and thruster tubes 30. This flexibility may be particularly helpful when being operated by a diver or ROV in order to have the apparatus 1 balanced, or assist reach in difficult to access dredging locations. The flexibility can be further promoted by using telescopic sections of pipe 10.

FIG. 14 illustrates an example apparatus 1 with the thrusters 34 being used in dredging mode. This arrangement may be used with only thrusters 34 providing the fluid flow to enable dredging operations, or may also be used in combination with a dredging head 2, 2*a* to provide an improved dredging performance. FIG. 14 illustrates the thruster 34 being used in combination with a dredging head 2, but flow through the dredging head 2 has not been illustrated for simplicity.

Use of Apparatus 1 in Mass-Flow Excavation Operation—FIGS. 15 & 16

Figures 15A, 15B:
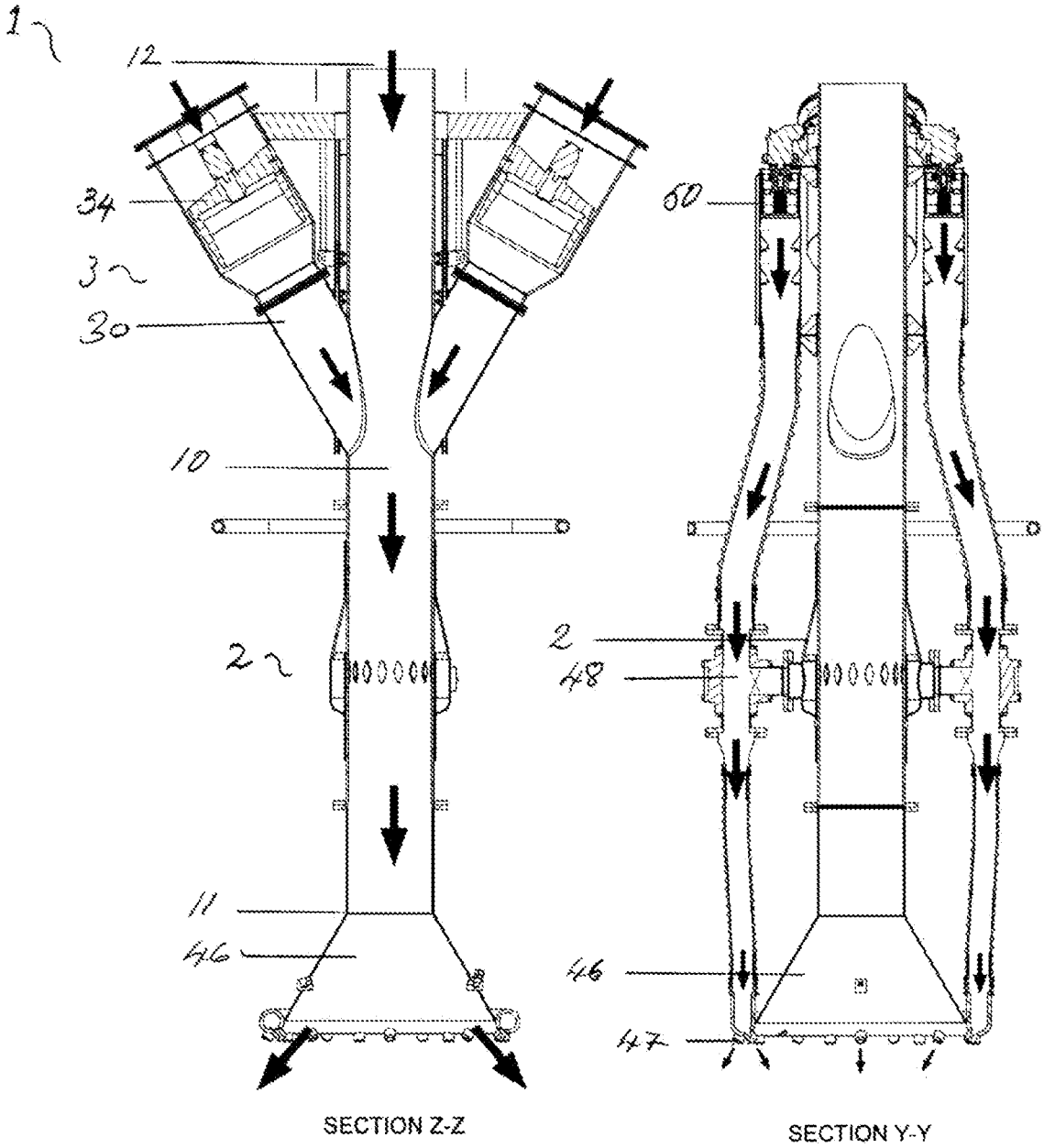
FIG. 15*a* shows a cross-sectional elevation of the example apparatus for underwater dredging of FIG. 1 but now configured for mass-flow excavation operations.
FIG. 15*b* shows another cross-sectional elevation (but with the apparatus rotated through 90 degrees compared to that of FIG. 15*a*) of the example apparatus of FIG. 1 for underwater dredging and also being shown configured for mass-flow excavation operations and additionally being shown as configured for jetting to assist said mass-flow excavation operations.

FIG. 15*a* illustrates an example apparatus 1 in mass-flow excavation mode. In this example thrusters 34 draw fluid into thruster tubes 30 from the immediate environment and force fluid to flow into the pipe 10 toward the first aperture 11. This also causes fluid to flow from the second aperture 12 to the first aperture 11. In the example of FIG. 15*a* the fluid then travels through the optional suction cone 46. When the end of the pipe 10, or the suction cone 46 is placed proximal to the bed, fluid exits the pipe 10 with sufficient force to excavate the substrate material. It can be advantageous during mass-flow excavation to not use a suction cone 46, or even to have a narrowing at the end of pipe 10 at the first aperture 11 because a reduction in the cross section of the pipe 10 will increase velocity of the fluid and cause it to impact with greater force on the substrate for the same flow rate, and be more effective at excavating the substrate. The flexibility of pipe length 10 disclosed above is also advantageous for mass-flow excavation.

FIG. 15*b* illustrates an example apparatus 1 in jetting mode. Jetting can be used with mass-flow excavation operations, e.g. as shown in FIG. 15*a*, or with dredging operations, e.g. as shown in FIG. 13. Jetting is advantageous for loosening material from the substrate. In this example, optional pumps 50 draw in ambient fluid and force it though a plurality of jetting heads/nozzles 47 which are circumferentially arranged around the suction cone 46. The fluid flow from the pumps 50 is directed to the jetting heads 47 by flow control valves 48. The control valves 48 could instead, or simultaneously, direct fluid into the dredging head 2.

Both FIGS. 15*a* and 15*b* show the dredging head 2 in a position indicating the first obstruction mechanism is active, i.e. deterring reverse fluid flow, as shown in the example of FIG. 8.

Figure 16A:
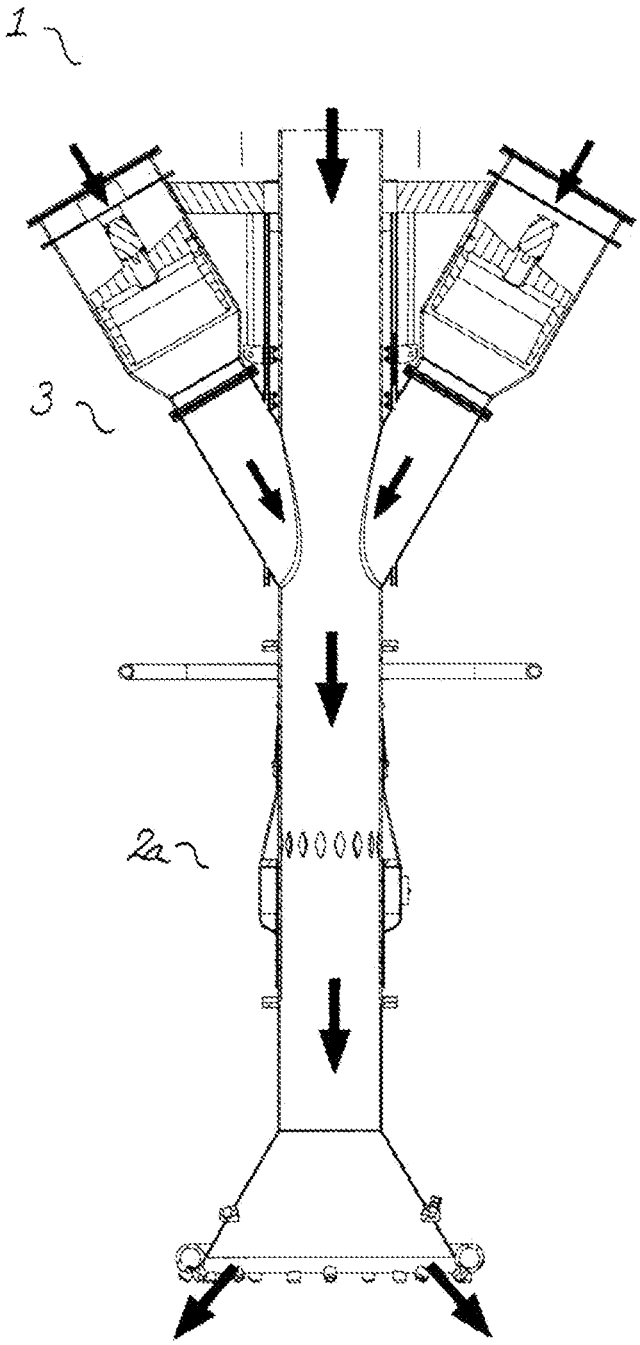
FIG. 16*a* shows a cross-sectional elevation of an example apparatus for underwater dredging configured for mass-flow excavation operations.
Figure 16B:
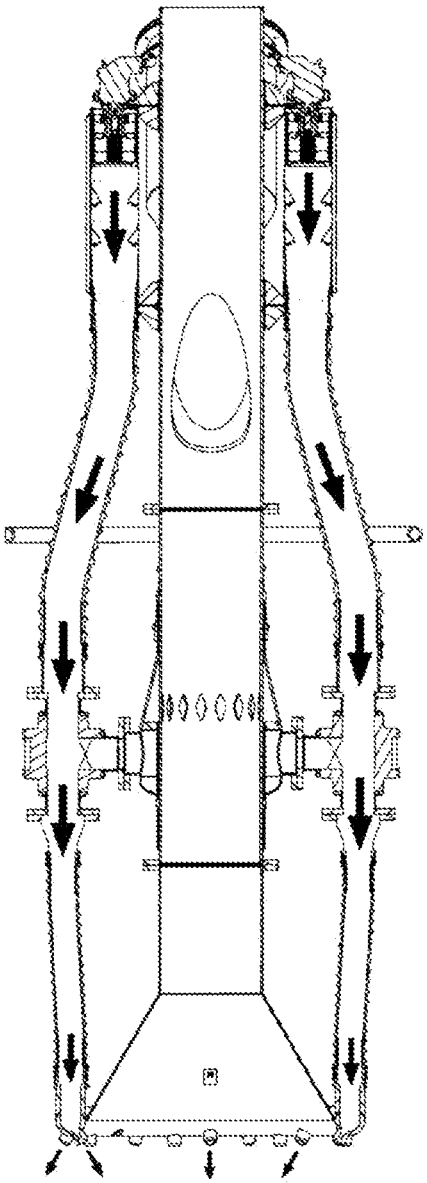
FIG. 16*b* shows a cross-sectional elevation of an example apparatus for underwater dredging configured for jetting.

FIGS. 16*a* and 16*b* show the same examples as 15*a* and 15*b*, except dredging head 2*a* is illustrated. The first blocking or obstruction mechanism 23*a* is active (i.e. preventing or reducing reverse fluid flow into the dredging head 2*a*), but the dredging head 2*a* is still in the same position relative to the pipe 10. This example blocking mechanism 23*a* is advantageous because it does not require movement of a significant part of the dredging head 2*a* relative to the pipe 10 which can affect the connections to inputs 20.

Modifications and/or improvements may be made to the examples/embodiments hereinbefore described without departing from the scope of protection.

The invention claimed is:

1. An apparatus for underwater dredging comprising:

a pipe; and a dredging head;

wherein the pipe comprises a first aperture and a second aperture each disposed at opposing ends of the pipe, and the pipe further comprises a sidewall, at least one first sidewall aperture and at least one second sidewall aperture;

wherein the dredging head is circumferentially arranged on the sidewall of the pipe and comprises at least one input, at least one output and a plenum chamber;

wherein the at least one output is in fluid communication with the at least one first sidewall aperture; and further comprising a first obstruction mechanism configured to selectively deter reverse fluid flow into the dredging head, wherein the first obstruction mechanism is configured to be selectively transformable between:— i) a first, obstructing, configuration in which at least reverse fluid flow through the dredging head is deterred; and ii) a second, open, configuration in which fluid flow through the dredging head is permitted; and further comprising at least one thruster tube, wherein the at least one thruster tube comprises a first thruster aperture, and a second thruster aperture, and further comprises a thruster disposed between the first thruster aperture and the second thruster aperture, wherein the at least one thruster tube is in fluid communication with the at least one second sidewall aperture.

2. An apparatus for underwater dredging as claimed in claim 1, wherein the at least one output of the dredging head is positioned at and surrounds the at least one first sidewall aperture and is configured to promote fluid flow in the pipe from the first aperture to the second aperture.

3. An apparatus for underwater dredging as claimed claim 1, wherein the dredging head further comprises at least one venturi.

4. An apparatus for underwater dredging as claimed in claim 1, wherein the first obstruction mechanism selectively obstructs the at least one first sidewall aperture.

5. An apparatus for underwater dredging as claimed in claim 1, wherein the first obstruction mechanism selectively obstructs a flow channel through the dredging head.

6. An apparatus for underwater dredging as claimed in claim 1, wherein the first obstruction mechanism is activated by translation of at least one component of the dredging head.

7. An apparatus for underwater dredging as claimed in claim 6, wherein the said translation of at least one component of the dredging head is at least one of a sliding or helical displacement of at least one component of the dredging head.

8. An apparatus for underwater dredging as claimed in claim 1, wherein the first obstruction mechanism is activated by rotation of at least one component of the dredging head.

9. An apparatus for underwater dredging as claimed in claim 1, further comprising a pump configured for providing fluid to the dredging head.

10. An apparatus for underwater dredging as claimed in claim 1, wherein the apparatus is configured to further provide for mass-flow excavation.

11. An apparatus for underwater dredging and mass-flow excavation as claimed in claim 10, wherein the at least one thruster tube is affixed to a sidewall of the pipe.

12. An apparatus for underwater dredging and mass-flow excavation as claimed in claim 11, wherein the at least one thruster tube surrounds the said at least one sidewall aperture and is configured to promote fluid flow in the pipe from the second aperture to the first aperture.

13. An apparatus for underwater dredging and mass-flow excavation as claimed in claim 12, additionally comprising a second obstruction mechanism configured to selectively deter fluid flow between the pipe and the thruster tube.

14. An apparatus for underwater dredging and mass-flow excavation as claimed in either of claim 12, wherein the thruster is switchably configured to promote fluid flow between the first thruster aperture and the second thruster aperture in either direction.

15. An apparatus for underwater dredging and mass-flow excavation as claimed in either of claim 13, wherein the second obstruction mechanism comprises a gate valve.

16. An apparatus for underwater dredging and mass-flow excavation as claimed in any of claim 11, wherein the thruster tube is affixed to a sidewall of the pipe at an angle of less than 80 degrees, measured between the centreline of the pipe and the centreline of the thruster tube.

17. A method of underwater dredging, the method comprising the steps of:

a) submerging an apparatus for underwater dredging in a body of water, and in any order;

b) performing a dredging operation, wherein a dredging head issues a first fluid flow into a pipe via an at least one first sidewall aperture, wherein the fluid flow is entering the pipe directed toward a second aperture, such that fluid flow in the pipe from a first aperture to the second aperture is promoted;

c) placing the first aperture of the pipe proximal to the seabed, wherein fluid flow into the first aperture extracts material from the seabed, and transporting said material through the pipe and ejecting it from the second aperture;

d) selectively operating an obstruction mechanism to selectively transform between:— i) a first, obstructing, configuration in which at least reverse fluid flow through the dredging head is deterred; and ii) a second, open, configuration in which fluid flow through the dredging head is permitted; and e) performing a mass-flow excavation operation, wherein a thruster tube issues a second flow into the pipe via at least one second sidewall aperture, wherein the fluid flow is entering the pipe directed toward the first aperture, promoting fluid flow from the second aperture to the first aperture.

18. A method of underwater dredging as claimed in claim 17, further comprising the steps of:

f) placing the first aperture of the pipe proximal to the seabed, wherein fluid flow out of the first aperture of the pipe ejects material from the seabed.

19. A method of underwater dredging as claimed in claim 17, wherein the method further comprises performing the dredging operation, wherein a thruster tube issues a second flow output of the pipe via at least one second sidewall aperture, wherein the fluid flow is exiting the pipe directed away from the first aperture promoting fluid flow in the pipe from a first aperture to the second aperture.

20. A method of underwater dredging as claimed in claim 18, wherein the dredging operation additionally comprises deterring fluid flow between the pipe and the thruster tube with a second obstruction mechanism.

21. A method of underwater dredging as claimed in claim 18, wherein the mass-flow excavation operation additionally comprises deterring reverse fluid flow into the dredging head with a first obstruction mechanism.

* * * * *